US012790788B2

(12) United States Patent
Ohmura et al.

(10) Patent No.: US 12,790,788 B2
(45) Date of Patent: Nov. 10, 2026

(54) METHOD OF CONTROLLING A SWING SYSTEM OF A WORK MACHINE

(71) Applicant: Caterpillar SARL, Geneva (CH)

(72) Inventors: Shinya Ohmura, Akashi (JP); Masaya Shirasaki, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 19/191,956

(22) Filed: Apr. 28, 2025

(65) Prior Publication Data

US 2025/0354353 A1 Nov. 20, 2025

(30) Foreign Application Priority Data

May 14, 2024 (GB) ..... 2406792

(51) Int. Cl.
*E02F 9/12* (2006.01)
*E02F 9/22* (2006.01)

(52) U.S. Cl.
CPC ..... *E02F 9/128* (2013.01); *E02F 9/2203* (2013.01); *E02F 9/2246* (2013.01); *E02F 9/2285* (2013.01)

(58) Field of Classification Search
CPC ..... E02F 9/123; E02F 9/125; E02F 9/128
See application file for complete search history.

(56) References Cited

U.S. PATENT DOCUMENTS 8,956,261 B2 * 2/2015 Komaru ..... F16D 65/853 475/331
9,353,813 B2 * 5/2016 Okuno ..... F16D 65/853
10,024,341 B2 * 7/2018 Zhang ..... E02F 9/2289
11,028,559 B2 * 6/2021 Kozui ..... F15B 11/17
11,795,660 B2 * 10/2023 Kondo ..... E02F 9/2228
12,428,808 B2 * 9/2025 Sato ..... F03C 2/08
2019/0039577 A1 2/2019 Nishimura
2022/0282453 A1 9/2022 Kondo

FOREIGN PATENT DOCUMENTS

GB 2641056 A * 11/2025 ..... E02F 9/2289
JP S6085359 U * 6/1985 ..... E02F 9/12
JP H04191293 A * 7/1992 ..... B66C 13/40
JP 2017024825 A 2/2017
JP 6156451 B2 * 7/2017 ..... B66C 27/36

* cited by examiner

*Primary Examiner* — Michael Leslie

(57) ABSTRACT

A method of controlling a swing system of a work machine is provided. The swing system comprises a parking brake and swing brake. The method comprises outputting a pilot pressure to the parking brake and the swing brake based on an operation mode of the swing system. When the pilot pressure is a first pilot pressure, the pilot pressure causes the parking brake to be applied to the swing system and the drift brake to be disapplied to the swing system. When the pilot pressure is a second pilot pressure, the pilot pressure causes the parking brake to be disapplied to the swing system and the drift brake to be disapplied to the swing system, the second pilot pressure being greater than the first pilot pressure. When the pilot pressure is a third pilot pressure, the pilot pressure causes the parking brake to be disapplied to the swing system and the drift brake to be applied to the swing system, the third pilot pressure being greater than the second pilot pressure.

15 Claims, 4 Drawing Sheets

METHOD OF CONTROLLING A SWING SYSTEM OF A WORK MACHINE

CROSS-REFERENCE TO RELATED APPLICATION

This application claims priority under 35 USC § 119 and the Paris Convention to Great Britain Patent Application No. 2406792.8 filed on May 14, 2024.

FIELD OF THE DISCLOSURE

The present disclosure relates to work vehicles. In particular, the present disclosure relates to a swing system for a work vehicle.

BACKGROUND

Work vehicles, such as an excavator, may include a swing system which is configured to rotate an upper body of the work vehicle (and any attached work tools) relative to a lower body of the work vehicle.

Conventionally, the swing system of a work vehicle may be driven by a hydraulic motor, which in turn may be actuated by hydraulic fluid provided by a hydraulic fluid pump.

In order to prevent unintentional rotation of the swing system when the work vehicle is not in use, the swing system may be provided with a parking brake. US-A-2022/282453 discloses a hydraulic system for a construction machine comprising control valves interposed between a main pump and hydraulic actuators; and first solenoid proportional valves connected to pilot ports of the control valves. The hydraulic system further includes: a brake for a slewing motor; and a second solenoid proportional valve connected to a brake release port of the brake by a secondary pressure line and connected to an auxiliary pump by a primary pressure line. A switching valve including a pilot port connected to the secondary pressure line by a pilot line is interposed between the auxiliary pump and the first solenoid proportional valves.

Against this background, the present disclosure provides an improved, or at least commercially relevant alternative, swing system controller.

SUMMARY

According to a first aspect, a method of controlling a swing system of a work machine is provided. The swing system comprises a parking brake and a drift brake. The method comprises outputting a pilot pressure to the parking brake and the drift brake based on an operation mode of the swing system. When the pilot pressure is a first pilot pressure, the pilot pressure causes the parking brake to be applied to the swing system and the drift brake to be disapplied to the swing system. When the pilot pressure is a second pilot pressure, the pilot pressure causes the parking brake to be disapplied to the swing system and the drift brake to be disapplied to the swing system, the second pilot pressure being greater than the first pilot pressure. When the pilot pressure is a third pilot pressure, the pilot pressure causes the parking brake to be disapplied to the swing system and the drift brake to be applied to the swing system, the third pilot pressure being greater than the second pilot pressure.

According to the first aspect, a pilot pressure is used to actuate both a parking brake and a drift brake of the swing system. As such, the method of the first aspect provides for the control of the parking brake and the drift brake of the swing system via a common pilot pressure.

Furthermore, according to the method of the first aspect the parking brake is applied at a first pilot pressure, which is lower than the second and third pilot pressures where the parking brake is disapplied. In effect, the parking brake is a negative brake (i.e. normally on brake) such that when the swing system is non-operational (e.g. in a parked mode), the parking brake may be applied to the swing system. Operation of the swing system which results in the pilot pressure being increased may allow the drift brake and parking brake to be disapplied to the swing system (e.g. to allow rotation of the swing system, or to apply the drift brake). As such, the drift brake may be a positive brake which is suitable for opposing rotation of the swing system during operation of the work vehicle.

According to a second aspect of the disclosure, a swing system controller for a swing system of a work machine is provided. The swing system controller is configured to:

- obtain an operation mode of the swing system;
- control a pilot pressure output to a parking brake and a drift brake of the swing system based on the operation mode, wherein the swing system controller is configured to cause the swing system to operate in:
  - a first configuration in which a first pilot pressure causes the parking brake to be applied to the swing system and the drift brake to be disapplied to the swing system;
  - a second configuration in which a second pilot pressure causes the parking brake to be disapplied to the swing system and the drift brake to be disapplied to the swing system, the second pilot pressure being greater than the first pilot pressure; and
  - a third configuration in which a third pilot pressure causes the parking brake to be disapplied to the swing system and the drift brake to be applied to the swing system, the third pilot pressure being greater than the second pilot pressure.

As such, the swing system controller of the second aspect may be configured to cause a swing system of a work machine to perform the method of the first aspect.

According to a third aspect of the disclosure, a swing system for a work vehicle is provided. The swing system is configured to cause an upper body of a work vehicle to rotate relative to a lower body of the work vehicle. The swing system comprises a parking brake configurable to apply a parking brake torque to oppose a rotation of the swing system based on a pilot pressure, and a drift brake configurable to apply a drift brake torque to oppose the rotation of the swing system based on the pilot pressure. The swing system also comprises a swing system controller according to the second aspect.

As such, the swing system of the third aspect may be used to perform a method according to the first aspect of the disclosure.

BRIEF DESCRIPTION OF THE FIGURES

Embodiments of the disclosure will now be discussed with reference to the following non-limiting figures in which.

DETAILED DESCRIPTION

According to an embodiment of the disclosure a work vehicle 1 comprising a swing system 3 is provided. The work vehicle also comprises a swing system controller which is configured to control the swing system 3. According to an embodiment of the disclosure, the swing system comprises a swing brake 10 which is configurable to oppose or prevent rotation of the swing system 3.

According to this disclosure, the work vehicle 1 may be an excavator (not shown). The work vehicle 1 may comprise an upper body and a lower body. The swing system 3 (not shown) of the work vehicle 1 may be configured to rotate the upper body of the work vehicle 1 (and any attached work tools) relative to the lower body of the work vehicle 1. The design of a swing system 3 for a work vehicle 1 such as an excavator and the like is known to the skilled person.

The swing system 3 may comprise a swing motor 4. The swing motor 4 may be configured to cause the upper body of the work vehicle 1 to rotate relative to the lower body of the work vehicle 1. In some embodiments, the swing motor 4 may be driven by a hydraulic system, which may be an open loop hydraulic system or a closed loop hydraulic system.

Figure 1:
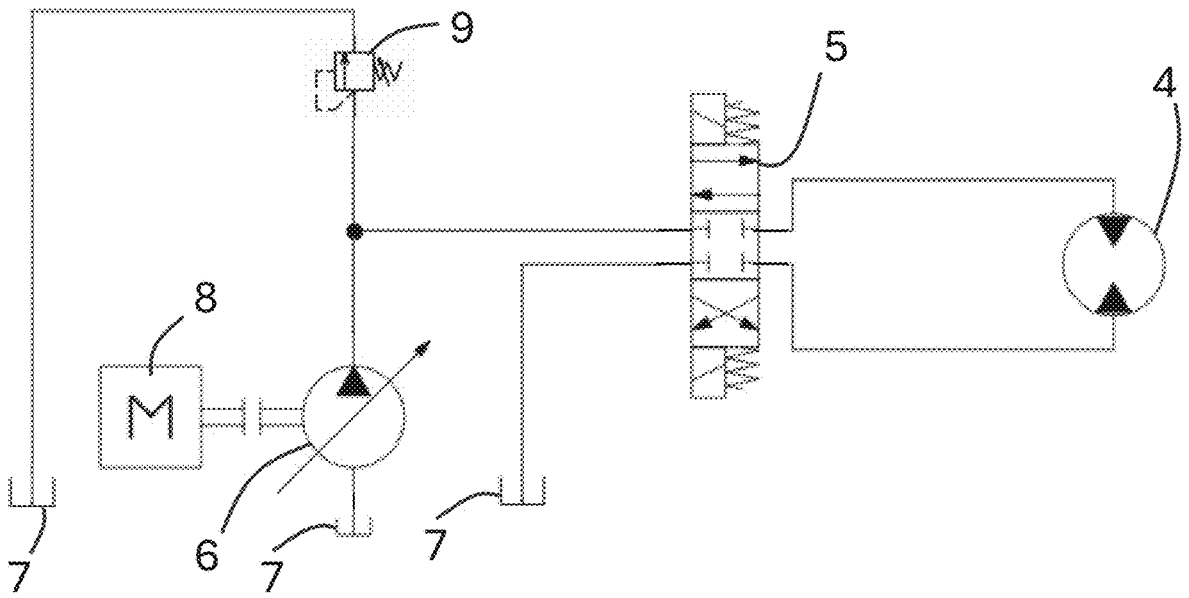
FIG. 1 is a diagram of an open loop hydraulic system for a swing system.

FIG. 1 shows a diagram of an open loop hydraulic system for a swing system 3. The open loop hydraulic system comprises a hydraulic motor 4, a directional control valve 5, a hydraulic pump 6, a hydraulic reservoir 7, a motor 8 and a pressure relief valve 9.

The hydraulic pump 6 is configured to pump hydraulic fluid to the swing motor to cause the swing motor to rotate. In the open loop hydraulic system of FIG. 1, the directional control 5 valve may be controlled in order to allow hydraulic fluid to flow to the hydraulic motor 4. The flow of hydraulic fluid to the hydraulic motor 4 may cause the hydraulic motor 4 to drive the swing system 3 in order to change the rotational position of the swing system 3. The directional control valve 5 of FIG. 1 is a 4/3 way directional control valve 5. When the rotational position of the swing system is to be maintained, the directional control valve 5 may be moved to the centre position where no hydraulic fluid flow is allowed. As such, operation of the directional control valve 5 to the centre position may provide for at least some resistance to unintentional rotation of the swing system 3 during use of the work vehicle.

As shown in FIG. 1, the open loop hydraulic system comprises a hydraulic reservoir 7 for storing hydraulic fluid. Hydraulic fluid may be supplied from the hydraulic reservoir 7 to the hydraulic pump 6. As shown in FIG. 1, hydraulic fluid may return to the hydraulic reservoir 7 via the directional control valve 5 or via the pressure relief valve 9. In the system of FIG. 1, the hydraulic pump 6 may be configured to pump a continuous flow of hydraulic fluid, wherein hydraulic fluid either flow through the directional control valve when open, or through the pressure relief valve 9 when the directional control valve 5 is in the (central) closed position. As such, during use hydraulic fluid may be continuously flowing back to the hydraulic reservoir 7.

Figure 2:
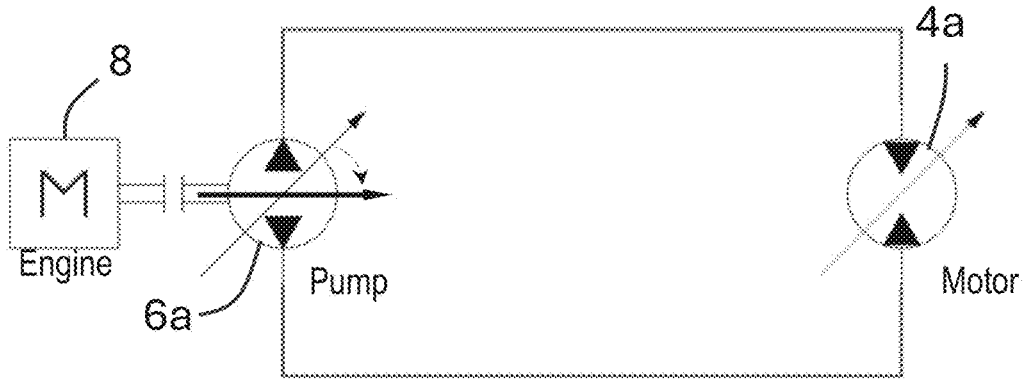
FIG. 2 is a diagram of a closed loop hydraulic system for a swing system.

FIG. 2 shows a diagram of a closed loop hydraulic system for a swing system 3. The closed loop hydraulic system comprises a hydraulic motor 4*a* and a hydraulic pump 6*a*. In general, a closed loop hydraulic system is configured to recycle the hydraulic fluid between the hydraulic pump 6*a* and the hydraulic motor 4*a*. As such, the hydraulic pump 6*a* of FIG. 2 may be a bidirectional hydraulic pump which is configured to directly drive the hydraulic motor 4*a*. Utilising a bidirectional hydraulic pump 6*a* in a closed loop hydraulic system allows the hydraulic motor 4*a* to be controlled using only the pump flow (i.e. the directional control valve of the open loop system is not required). Thus, in the closed loop system of FIG. 2, hydraulic fluid may only flow through the system when it is desired to rotate the swing system 3. When no rotation of the swing system 3 is desired, the hydraulic pressure output by the hydraulic pump 6*a* may be used to maintain the rotational position of the swing motor 4*a*. It will be appreciated that the closed loop hydraulic system may be more prone to unintentional rotation of the swing system. In particular, during use of the closed loop hydraulic system, internal hydraulic fluid leakage in the closed loop circuit may result in unintentional drift/slippage of the swing motor 4*a*/swing system 3. To reduce or prevent unintentional drift/slippage of the swing system 3 during use, the swing system 3 may be controlled according to embodiments of this disclosure.

The swing system 3 comprises a swing brake 10. The swing brake 10 may be provided to oppose or prevent the rotation of the swing system 3 (i.e. the rotation of the upper body of the work vehicle 1 relative to the lower body of the work vehicle 1. The swing brake 10 comprises a parking brake 20 and a drift brake 30.

Figure 3A:
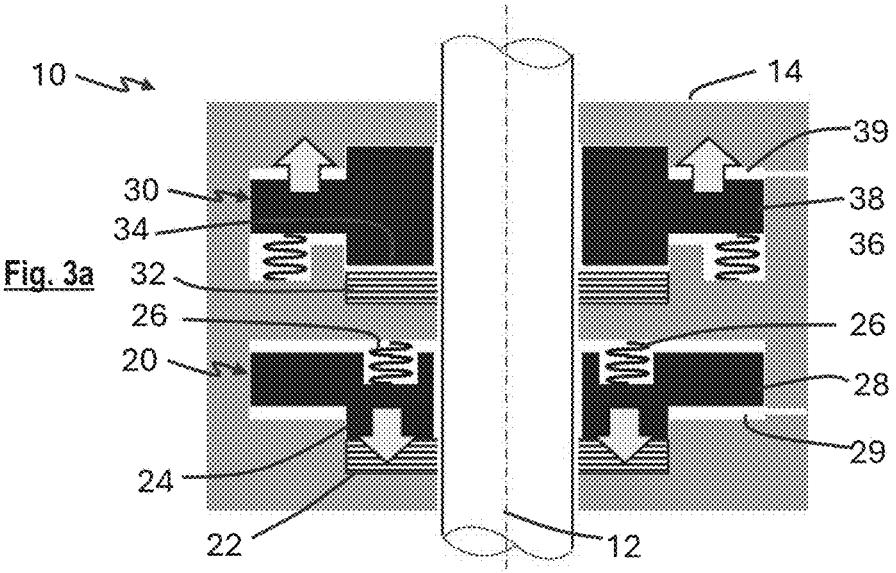
FIGS. 3*a*, 3*b* and 3*c* are cross-sectional diagrams of a swing brake according to this disclosure in different configurations.

As shown in FIG. 3*a*, the swing brake 10 may be provided about a central axis 12 of the swing brake 10. The swing brake may be configured to apply a torque to a drive shaft 16 of the swing system 3. The drive shaft 16 may connected to the hydraulic motor 4, 4*a*. Rotation of the drive shaft 16 may cause the upper body of the work vehicle 1 to rotate relative to the lower body of the work vehicle 1 (not necessarily about the central axis 12 of the drive shaft 16). The swing brake 10 may comprise a swing brake housing 14. The swing brake housing 14 may be connected to the lower body or upper body of the work vehicle 1. In the embodiment of FIG. 3*a*, the swing brake housing is connected to the upper body of the work vehicle 1. The drive shaft 16 which extends through the swing brake 10 may be connected to a swing drive unit (not shown in FIG. 3*a*) comprising a reduction gear set.

While in the embodiment of FIG. 3*a* the parking brake 20 and the drift brake 30 are integrated together as a swing brake 10, in other embodiments, the parking brake 20 and the drift brake 30 may be provided as separate brakes for the swing system 3.

The parking brake 20 is configurable to apply a parking brake torque to oppose a rotation of the swing system 3.

FIG. 3*a* shows a schematic cross sectional diagram of the parking brake 20 according to an embodiment of the disclosure. The parking brake 20 comprises at least one parking brake disc 22, at least one parking friction disc 24, a first spring element 26, and parking piston 28. As shown in FIG. 3*a*, the first spring element 26 is configured to bias the parking friction discs 24 towards the parking brake discs 22. In the absence of any external forces, the first spring element 26 is configured to resiliently bias the parking friction discs 24 towards the parking brake discs 22 such that the parking friction discs 24 and parking brake discs 22 are in contact with each other. The force applied by the first spring element 26 is such that a parking brake torque is applied between the parking friction discs 24 and the parking brake discs 22. As such, the parking brake 20 is a negative brake which, in the absence of any force applied from parking brake piston 28, applies the parking brake torque to the swing system 3 to prevent or oppose rotation of the swing system 3.

Figure 3B:
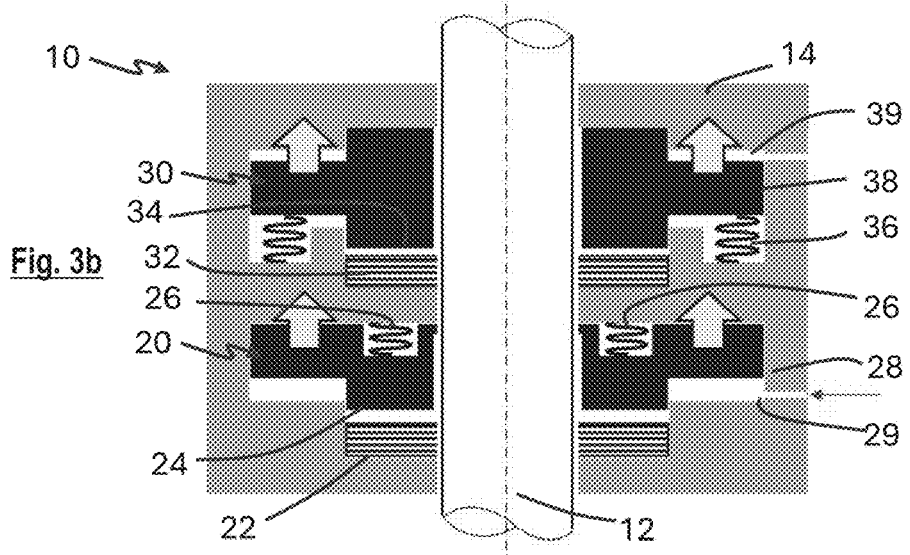
Figure 3C:
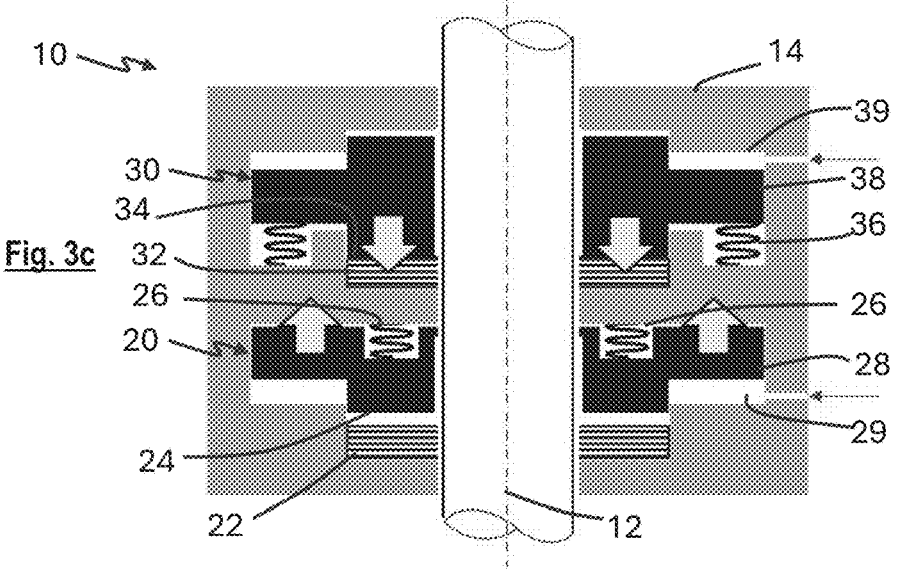

The at least one parking brake disc 22 may be generally annular shaped. Each parking brake disc 22 may be disposed about the central axis 12 as shown in FIG. 3*a*. Each parking brake disc 22 may have a first coefficient of friction. The parking brake disc 22 may be connected to the first swing brake body or the second swing brake body. In the embodiment of FIGS. 3*a*-3*c*, a plurality of parking brake discs 22 are provided. The plurality of parking brake discs 22 are arranged alternately with the at least one parking friction discs 24 along the central axis 12 of the drive shaft 16. In the embodiment of FIG. 3*a*, each parking brake disc 22 is configured to engage with the swing brake housing 14. That is to say, each parking brake disc 22 is fixed to the swing brake housing 14, while the drive shaft 16 is free to rotate relative to the swing brake housing 14.

The at least one parking friction disc 24 may be configured to contact the at least one parking brake disc 22 when the parking brake 20 is engaged. Each parking friction disc 24 may have a first friction disc coefficient of friction. As shown in FIG. 3*a*, each parking friction disc 24 may also be annular shaped. In the embodiment of FIGS. 3*a*-3*c*, a plurality of parking friction discs 24 are provided. The plurality of parking friction discs 24 may be arranged alternately with the at least one parking brake discs 22. In the embodiment of FIG. 3*a*, each parking friction disc 24 may be configured to engage with the drive shaft 16. As such, each parking friction disc 24 may be configured to rotate with the drive shaft 16 (i.e. at the same rotation speed as the drive shaft 16). That is, each parking friction disc 24 may rotate relative to the at least one parking brake disc 22 when the drive shaft 16 of the swing system 3 rotates.

A plurality of spring elements 26 may be disposed about the parking friction discs 24 in order to apply the parking brake torque evenly about the central axis 12. As such, the one or more spring elements 26 may be configured to apply a force to the parking brake piston 28 to bias the parking brake discs 22 and the parking friction discs 24 together in order to oppose the rotation of the drive shaft 16.

The parking brake piston 28 is depicted schematically in FIG. 3*a*. As shown in FIG. 3*a*, the parking brake piston 28 is provided within a parking brake cylinder volume 29. The parking brake cylinder volume 29 may be defined, at least in part, by the swing brake housing 14 as shown in FIG. 3*a*. In other embodiments, the parking brake cylinder volume 29 may be defined by a parking brake cylinder (not shown) in which the parking brake piston 28 is disposed. As such, in some embodiments the parking brake 20 comprises a parking brake hydraulic actuator, wherein the parking brake hydraulic actuator is configured to apply a force to oppose a force applied by the first spring element 26.

The parking brake cylinder volume 29 may be configured to receive a flow of hydraulic fluid from the hydraulic system. As will be appreciated from FIG. 3*b*, when hydraulic fluid is pumped into the parking brake cylinder volume, the hydraulic fluid pressure generates a force which opposes the spring force applied by the first spring element 26. As such, with sufficient hydraulic pressure the parking brake piston 28 may be displaced in the parking brake cylinder volume 29 such that the parking friction discs 24 are separated from the parking brake discs 22.

It will be appreciated that the first spring element 26 applies a force to the parking brake piston 28 which acts to force the parking friction discs 24 towards the parking brake discs 22. As such, when the hydraulic fluid pressure supplied to the parking brake cylinder 29 is reduced, the first spring element 26 may act to return the piston 28 to the position shown in FIG. 3*a*, wherein the hydraulic fluid is driven out of the parking brake cylinder 29. In the embodiment of FIG. 3*a*, the first spring elements 26 are depicted as helical springs. It will be appreciated that any suitable spring element may be used to resiliently bias the parking friction discs 24 towards the parking brake discs 22.

The drift brake 30 is configurable to apply a drift brake torque to oppose the rotation of the swing system 3. As shown in FIG. 3*a*, the drift brake 30 is a positive brake comprising a second spring element 32 configured to oppose the application of the drift brake torque. The drift brake 30 comprises at least one drift brake disc 32, at least one drift friction disc 34, a second spring element 36, and drift piston 38. As shown in FIG. 3*a*, the second spring element 36 is configured to bias the drift friction discs 34 away from the drift brake discs 32. So, in the absence of any external forces, the second spring element 36 is configured to separate the drift friction discs 34 from the drift brake discs 32. The force applied by the second spring element 36 may be significantly lower than the force applied by the first spring element 26. As such, the drift brake 30 is a positive brake which wherein the second spring element opposes the application of the drift brake torque.

Similar to the parking brake 20, each drift brake disc 32 may be generally annular shaped. The drift brake discs 32 may be disposed about the central axis 12 as shown in FIG. 3*a*. The drift brake discs 32 may each have a second coefficient of friction. In some embodiments, the first coefficient of friction of each of the parking brake discs 22 is different to the second coefficients of friction of the drift brake discs 32. Accordingly, the performance characteristics of the parking brake 20 and the drift brake 30 may be selected in order to meet different objectives. For example, in some embodiments, the second coefficient of friction may be lower than the first coefficient of friction. As such, the parking brake disc 22 may be provided with a relatively high first coefficient of friction to provide a reliable application of the relatively high parking brake torque. One possible consequence of the selection of a relatively high coefficient of friction for a disc brake is that the wear rate of the disc brake may be increased. For a parking brake 20, which is intended to be applied only when the vehicle is stationary, the expected wear rate of the parking disc brake may be relatively low. The drift brake discs 32 may be provided with a relatively lower second coefficient of friction to reflect that the drift brake discs 32 are intended to be applied when the work vehicle 1 may be operational. In such use cases, unintentional slippage of the swing brake may occur. Accordingly, the second coefficient of friction of the drift brake discs 32 may be selected in order to improve the lifetime of the drift brake discs 32 (relative to a disc brake having the same first coefficient of friction).

In the embodiment of FIG. 3*a*, each drift brake disc 32 may configured to engage with the swing brake housing 14. That is to say, each drift brake disc 32 may be fixed to the swing brake housing 14, while the drive shaft 16 is free to rotate relative to the swing brake housing 14. As such, the drift brake discs 32 may be connected to the same swing brake body of the swing brake 10 as the parking brake discs 22.

The drift friction discs 34 may be configured to contact the drift brake discs 32 when the drift brake is engaged. The drift friction discs 34 may have a second friction disc coefficient of friction. The first friction disc coefficient of friction may be lower than the second friction disc coefficient of friction, similar to the coefficients of friction for the brake discs 22, 32 discussed above. In the embodiment of FIGS. 3*a*-3*c*, a plurality of drift friction discs 34 are provided. The plurality of drift friction discs 34 may be arranged alternately with the at least one drift brake discs 32. In the embodiment of FIG. 3*a*, each drift friction disc 34 may be configured to engage with the drive shaft 16. As such, each drift friction disc 34 may be configured to rotate with the drive shaft 16. That is, each drift friction disc 34 may rotate relative to the at least one drift brake disc 32 when the swing system 3 rotates.

As shown in FIG. 3*a*, the drift brake piston 38 may be configured to apply a force to bias the drift brake discs 32 and the drift friction discs 34 together in order to oppose the rotation of the drive shaft 16.

A plurality of second spring elements 36 may be disposed about the drift friction discs 34 in order to apply the drift brake torque evenly about the drive shaft 16. In some embodiments, the force applied by the one or more second spring elements 36 may be greater than the force applied by the first spring elements 26.

The drift brake piston 38 is depicted schematically in FIG. 3*a*. As shown in FIG. 3*a*, the drift brake piston 38 may be provided within a drift brake cylinder volume 39. The drift brake cylinder volume 39 may be defined, at least in part, by the swing brake housing 14 as shown in FIG. 3*a*. In other embodiments, the drift brake cylinder volume 39 may be defined by a drift brake cylinder (not shown) in which the drift brake piston 38 is disposed. The drift brake cylinder volume 39 may be configured to receive a flow of hydraulic fluid from the hydraulic system. As such, in some embodiments, the drift brake 30 may comprise a drift brake hydraulic actuator, the drift brake hydraulic actuator configured to apply a force to oppose a force applied by the second spring element 36.

As will be appreciated from FIG. 3*c*, when hydraulic fluid is pumped into the drift brake cylinder volume 39, the hydraulic fluid pressure generates a force which opposes the spring force applied by the second spring element 36. As such, with sufficient hydraulic pressure the drift brake piston 38 may be displaced in the drift brake cylinder volume 39 such that the drift friction disc 34 contact, and may apply a torque to the drift brake discs 32. The torque applied to the drift brake discs 32 may be proportional to the force exerted on the drift drake piston 38 from the hydraulic fluid pressure.

It will be appreciated that the second spring element 36 applies a force to the drift brake piston 38 which acts to resiliently bias the drift friction discs 34 and the drift brake discs 32 away from each other. As such, when the hydraulic fluid pressure supplied to the drift brake cylinder 39 is reduced, the second spring element 36 may act to return the return the drift brake piston 38 to the position shown in FIG. 3*a*, wherein the hydraulic fluid is driven out of the drift brake cylinder 39. In the embodiment of FIG. 3*a*, the second spring elements 36 are depicted as helical springs. It will be appreciated that any suitable spring element may be used to resiliently bias the drift friction discs 34 and the drift brake discs 32 together.

FIGS. 3*a*, 3*b* and 3*c* depict a swing brake 10 in which the parking brake 20 and the drift brake 30 are arrange concentrically about the central axis 12. In the embodiment of FIG. 3*a*, the parking brake 20 and the drift brake 30 each extend in a plane transverse to the central axis 12. In the embodiment of FIG. 3*a*, the parking brake 20 and the drift brake 30 extend in planes which are vertically offset from each other. In some embodiments, for example as shown in FIG. 3*a*, the parking brake 20 and the drift brake 30 may each have an internal diameter, which may be defined by an internal diameter of the parking brake disc 22 and the drift brake disc 32 respectively. In the embodiment of FIG. 3*a*, the internal diameter of the parking brake 20 and the drift brake 30 are the about the same. In other embodiments, the internal diameters may be different. In other embodiments, the parking brake 20 and the drift brake 30 may extend in the same plane, wherein the parking brake 20 and the drift brake have different internal diameters. As such, it will be appreciated that the swing brake 10 of this disclosure is not limited to the arrangement of the parking brake 20 and the drift brake 30 shown in FIG. 3*a*.

As will be appreciated from FIGS. 3*a*, 3*b* and 3*c*, the swing brake 10 may be configured in one of three configurations. In a first configuration as shown in FIG. 3*a*, the parking brake 20 is configured to apply the parking brake torque to the swing system 3 and the drift brake 30 is configured to apply no torque to the swing system 3. As such, the first configuration may be suitable for operating the work vehicle 1 in a parking mode (i.e. the work vehicle 1 is parked). As the parking brake 20 is a negative brake, the parking brake 20 can be applied without requiring the hydraulic pump 6, 6*a* to be operational.

In a second configuration as shown in FIG. 3*b*, the parking brake 20 may be configured to apply no torque and the drift brake 30 may be configured to apply no torque. As such, in the second configuration, the swing brake 10 may be configured to not oppose rotation of the swing system 3. Thus, in the second configuration the swing system 3 may cause the hydraulic motor 4, 4*a* to rotate the upper body relative to the lower body. That is, when rotation of the swing system 3 is desired, the swing brake 10 may be in the second configuration.

In a third configuration as shown in FIG. 3*c*, the parking brake 20 may be configured to apply no torque and the drift brake 30 may be configured to apply the drift brake torque. Thus, in the third configuration the drift brake 30 may be engaged in order to prevent or oppose rotation of the swing system 3. As discussed above, the drift torque applied by the drift brake 30 is lower than the parking brake torque. The third configuration of the swing brake 10 may be utilised when the work vehicle is in operation and it is desired that the swing system 3 does not rotate (e.g. the work vehicle 1 is performing a digging operation or a driving operation). During such operations, it may not be desirable to apply the higher parking brake torque, as such a relatively high torque may result in excessive stress/strain being placed on the swing system 3/work vehicle 1. Thus, the drift brake 30 may be used to apply a lower drift brake torque in order to reduce and/or prevent damage to the swing system 3/work vehicle 1. As the drift brake 30 is intended to be engaged while the work vehicle 1 is in operation, the drift brake is a positive brake. Furthermore, the design of the swing brake 30 may be optimised for improved wear (e.g. optimising of the drift brake disc 22) relative to the parking brake 20 to reflect the different usage of the drift brake 30.

As described above, the parking brake 20 and the drift brake 30 may each be operated by the flow of hydraulic fluid to and from the parking brake cylinder volume 29 and the drift brake cylinder volume 39 respectively. As such, in some embodiments the work vehicle 1 may comprise a swing brake hydraulic system which is configured to control/operate the swing brake 10. The swing brake hydraulic system may comprise a swing brake pump which is configured to pump hydraulic fluid from a hydraulic fluid reservoir (e.g. hydraulic reservoir 7) to parking brake 20 and to the drift brake 30.

The swing brake hydraulic system may be configured to output a variable pilot pressure in order to control the parking brake 20 and the drift brake 30. As such, the swing brake hydraulic system may be a pilot pressure system through which the swing brake 10 is operated.

As discussed above, the swing system 3 may comprise a swing system controller (not shown in FIG. 3*a*) which is configured to control the swing brake 10. The swing system controller may be any suitable processor or computer. In some embodiments, the swing system 3 may comprise a dedicated processor (i.e. separate to a controller of the work vehicle 1). In other embodiments, the functionality of the swing system controller may be integrated into another controller of the work vehicle, such as an Engine Control Unit (ECU).

Next, a method of controlling the swing system 3 will be described with reference to FIGS. 4*a*, 4*b* and 5. The method comprises outputting a pilot pressure to the parking brake 20 and the drift brake 30 based on an operation mode of the swing system 3. In some embodiments, the swing system controller may determine the operation mode of the swing system 3 and select a pilot pressure to be output to the parking brake 20 and the drift brake 30 accordingly.

In some embodiments, the swing brake hydraulic system may comprise a hydraulic pump 40 and a proportional valve 50. The proportional valve 50 may be configurable to output the variable pilot pressure. In some embodiments, the proportional valve 50 may comprise a solenoid wherein a current received by the solenoid (under the control of the swing system controller) controls the variable opening of the proportional valve 50. A hydraulic system diagram showing the proportional valve 50 is shown in FIG. 5.

In an embodiment, the hydraulic pump 40 may be configured to pump hydraulic fluid to the proportional valve 50. The proportional valve 50 may be a 3/2 way proportional valve. The proportional valve 50 may be configured to supply hydraulic fluid to the parking brake 20 and the drift brake 30 at a pilot pressure controlled by the proportional valve 50. The proportional valve 50 may also be connected to a hydraulic reservoir 7 to provide a return path for hydraulic fluid.

Figure 4A:
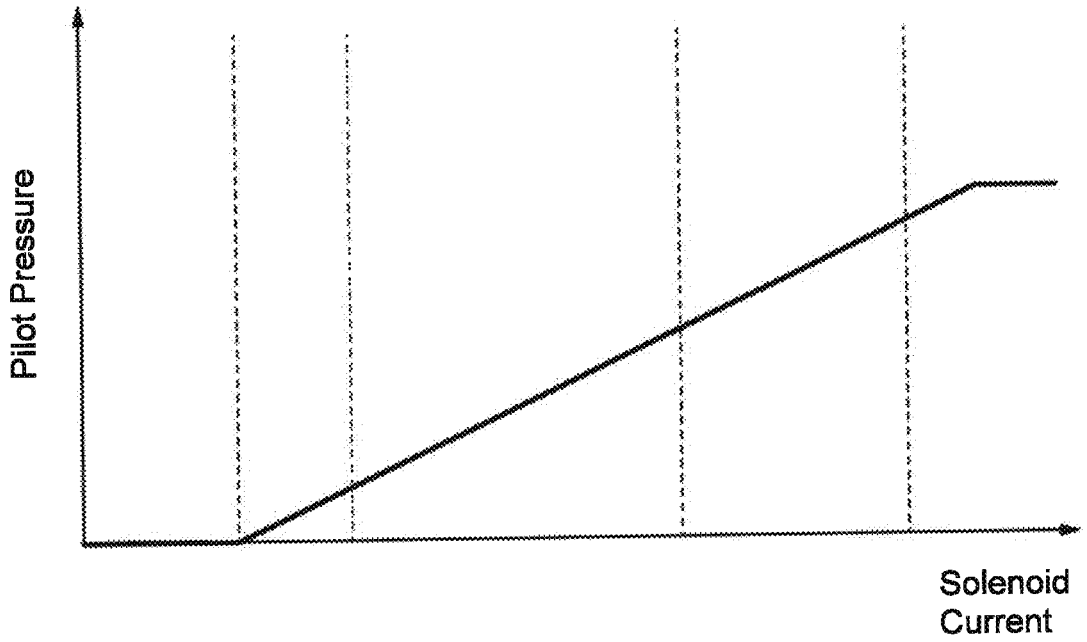
FIGS. 4*a* and 4*b* are graphs showing a change in pilot pressure and brake torque as the swing brake system is operated.
Figure 5:
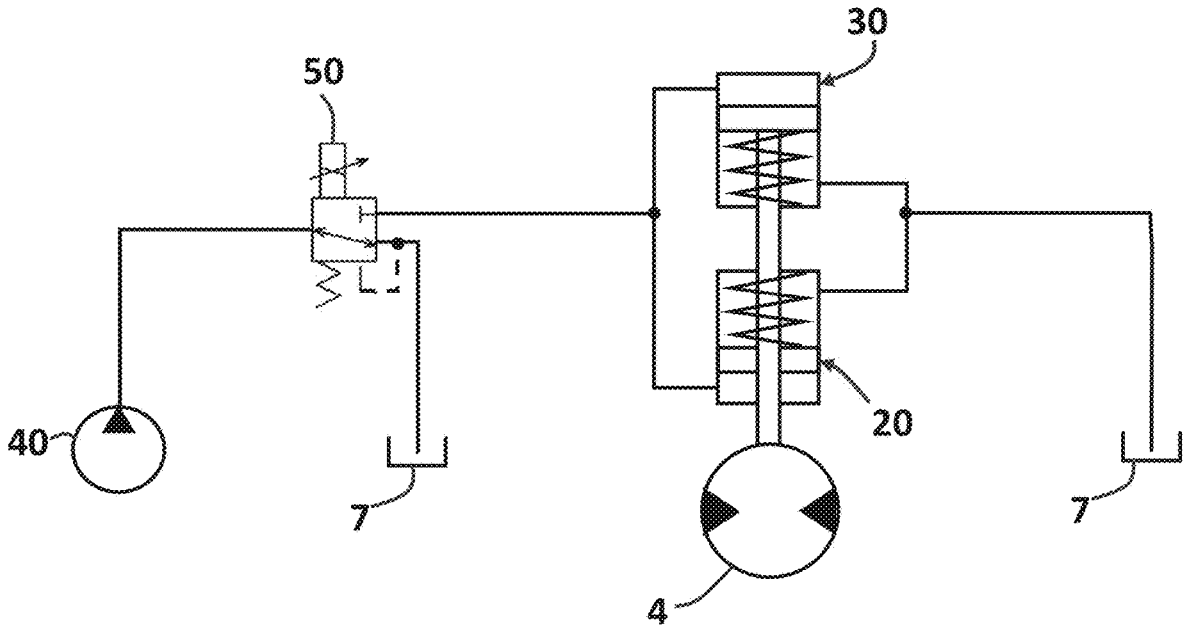
FIG. 5 shows a hydraulic system diagram according to this disclosure.

By way of explanation, FIG. 4*a* shows a graph which is indicative of a pilot pressure output from the proportional valve 50 in response to a current supplied to the solenoid of the proportional valve 50. As shown in FIG. 4*a*, below a minimum current the pilot pressure output by the proportional valve 50 is essentially zero (i.e. the proportional valve 50 is closed and no hydraulic fluid flows through the valve). As the current supplied to the solenoid increases, the proportional valve 50 starts to open and the pilot pressure of the hydraulic fluid increases accordingly. In the embodiment of FIG. 4*a*, the relationship between the solenoid current and the pilot pressure is indicated to be substantially linear. In other embodiments, other current/pressure relationships may be provided. Above a certain solenoid current, the proportional valve is fully open and the pilot pressure reaches a maximum pilot pressure.

Figure 4B:
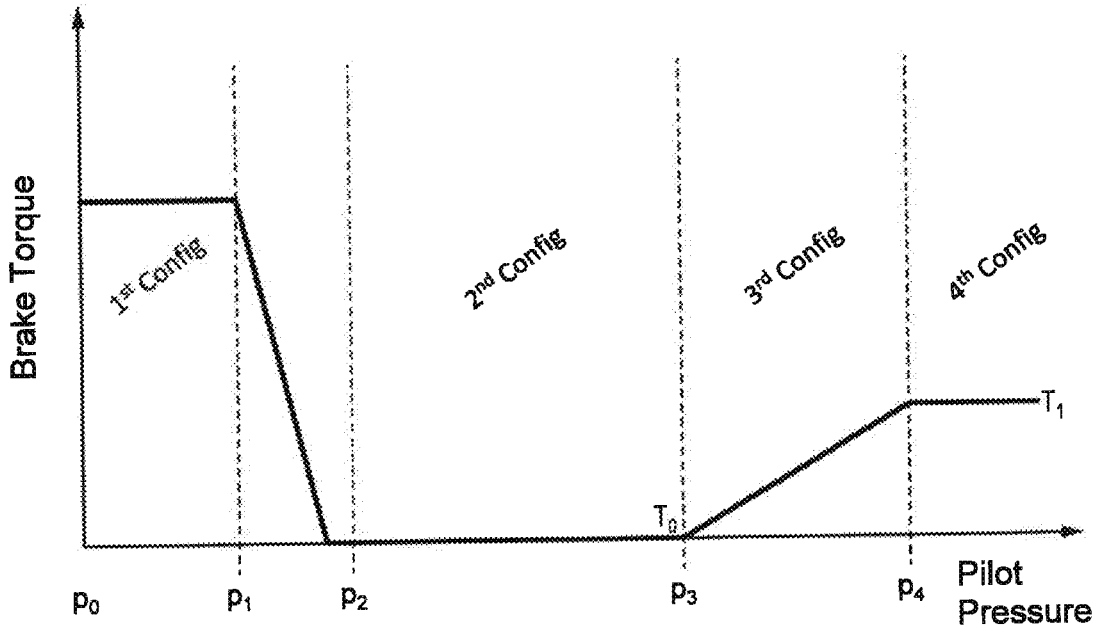

FIG. 4*b* shows a graph of the brake torque applied by the swing brake 10 when the parking brake 20 and the drift brake 30 are each controlled by the pilot pressure from the proportional valve 50.

As shown in FIG. 4*b*, when the pilot pressure (p) is a first pilot pressure (e.g. $p_o \leq p < p_1$ as shown in FIG. 4*b*), the pilot pressure causes the parking brake 20 to be applied to the swing system 3 and the drift brake 30 to be disapplied to the swing system 3. So, as shown in FIGS. 4*a* and 4*b*, when no solenoid current is supplied, the pilot pressure is substantially zero. Accordingly, there is insufficient hydraulic pressure supplied to the swing brake 10 to overcome the force applied to the parking brake 20 by the first spring element 26 such that the parking brake 20 (negative brake) is applied to the swing system 3. There is also insufficient hydraulic pressure to overcome the force applied to the drift brake 30 by the second spring element 36 such that the drift brake 30 is not applied to the swing system 3. As such, as shown in FIG. 4*b*, the swing brake 10 is in the first configuration ($1^{st}$ Config).

In some embodiments, the parking brake 20 may be a negative break such that where the parking brake 20 is applied to the swing system 3, the parking brake 20 applies a predetermined parking brake torque to the swing system 3. In the embodiment of FIG. 3*a*, the first spring element 26 may be configured to resiliently bias the parking brake to apply the predetermined parking brake torque.

When the pilot pressure (p) is a second pilot pressure (e.g. $p_2 \leq p < p_3$), the pilot pressure causes the parking brake 20 to be disapplied to the swing system 3 and the drift brake 30 to be disapplied to the swing system 3, the second pilot pressure being greater than the first pilot pressure. That is, the second pilot pressure is sufficient to fully disapply the parking brake 20. However, the second pilot pressure is not sufficient to overcome the force applied by the second spring element 36 such that the drift brake 30 is not applied. Accordingly, the swing brake 10 may be operated in the second configuration ($2^{nd}$ Config) where both the parking brake 20 and the drift brake 30 are not applied and the swing system 3 is able to rotate.

When the pilot pressure is a third pilot pressure (e.g. $p_3 < p$), the pilot pressure causes the parking brake 20 to be disapplied to the swing system 3 and the drift brake 30 to be applied to the swing system 3, the third pilot pressure being greater than the second pilot pressure. So, at the third pilot pressure the parking brake 20 remains disapplied. The third pilot pressure causes the pilot pressure to overcome the force applied by the second spring element 36 such that the drift brake 30 is now applied. As shown in FIG. 4*b*, the torque applied by the drift brake 30 may increase with as the pilot pressure increases above $p_3$.

In some embodiments, when the drift brake 30 is applied to the swing system 3, the drift brake 30 applies a drift brake torque to the swing system 3, wherein the drift brake torque is lower than the parking brake torque.

It will be noted that between the pressures $p_1$ and $p_2$ shown in FIG. 4*b*, the pilot pressure is sufficient to partially to lift (but not fully disapply) the parking brake 20. It may not be desirable to operate the swing brake 10 in this pilot pressure region where the parking brake 20 is partially applied (between the $1^{st}$ Config and $2^{nd}$ Config of FIG. 4*b*) in order to avoid unnecessary wear of the parking brake 20.

In some embodiments, when the pilot pressure is between a third pilot pressure and a fourth pilot pressure ($p_3 \leq p \leq p_4$), the fourth pilot pressure being greater than the third pilot pressure, the drift brake torque applied to the swing system 3 may be varied between a minimum drift brake torque ($T_0$) and a maximum drift brake torque ($T_1$) based on the pilot pressure (p). As such, in some embodiments, the swing system controller may control the drift brake torque to be applied to the swing system 3 using the pilot pressure.

As such, in some embodiments, the pilot pressure system may be used to control the parking brake 20 and the drift brake 30 of the swing brake 10 using a single proportional valve 50. Such an implementation allows the swing brake 10 to be controlled in a simplified manner using a single proportional valve 50 as shown in FIG. 5. As the pilot pressure causes the parking brake 20 to be applied at a different pressure range ($p_0 \leq p < p_1$) to the pressure range where the drift brake is applied ($p_3 \leq p$), the control method of this disclosure ensures that the parking brake 20 and the drift brake 30 cannot be applied simultaneously. This in turn ensures that the swing system 3 is not placed in a configuration where it is may be subject to an excessive brake torque (the combined parking brake torque and drift brake torque).

In some embodiments, the swing system controller may be configured to control the parking brake 20 and the drift brake 30 based on an operating mode of the work vehicle 1. As such, in some embodiments, the method may further comprise a step of the swing system controller obtaining information indicative of an operation mode of the work vehicle.

In some embodiments, the swing system controller may obtain information indicative of the work vehicle 1 being in a parked operation mode. When the work vehicle is in the parked operation mode, the method further comprises causing the pilot pressure system to output the first pilot pressure such that the system is in the first configuration. Furthermore, when the work vehicle 1 is not operational, the swing brake 10 may also defaults to the first configuration due to the negative parking brake 20 and the positive drift brake 30.

Where the swing system controller obtains information indicative of the work vehicle 1 being in a swinging operation mode, the method further comprises causing the pilot pressure system to output the second pilot pressure. A swing operation mode may be an operating mode where the swing system controller determines that rotation of the swing system 3 is desired. In the swinging system, the swing brake may be in the second configuration to allow rotation of the swing system 3.

Where information indicative of the work vehicle being in a digging operation mode or a driving operation mode is obtained, the method further comprises outputting a pilot pressure of at least the third pilot pressure and up to the fourth pilot pressure. In such an operation mode, it may be desirable to apply the drift brake 30.

As shown in FIG. 4*b*, when the swing brake 10 is operated in the third configuration, the swing system controller may utilise the pilot pressure system to control the drift brake torque applied by the swing brake 10. As such, in some embodiments, the swing system controller may control the drift brake torque applied based on the operating mode of the work vehicle 1. For example, in some embodiments it may be desirable to vary the drift brake torque applied based on positional information of the work vehicle. That is, it may be desirable to increase the drift brake torque when the work vehicle is operating on an incline for example. Thus, in some embodiments, the method may further comprise the swing system controller obtaining positional information indicative of a position of the swing system 3 and/or a position of the work vehicle 1. The drift brake torque applied by the drift brake 30 may then be controlled based on the obtained positional information.

In some embodiments, the positional information of the swing system 3 may be derived by the swing system controller from one or more positional information sensors of the work vehicle 1 (e.g. one or more gyroscopes, accelerometers and the like connected to the work vehicle). In some embodiments, positional information of the work vehicle 1 may be provided by the ECU of the work vehicle 1. In some embodiments, the positional information may comprise one or more of a yaw, pitch, and roll of the swing system 3. The swing system controller may determine the drift brake torque to be applied by the swing brake 10 based on the positional information.

For example, where the swing system 3 is operating on substantially level ground, the swing system controller may determine that a first drift brake torque is to be applied by the swing brake 10. Where it is determined that at least one of a pitch, yaw, and roll of the swing system 3 is above first threshold, the swing system controller may determine that a second drift brake torque is to be applied by the swing brake 10, where the second drift brake torque is higher than the first drift brake torque. In other embodiments, a linear relationship between one or more of the pitch, yaw, and roll of the swing system 3 and the drift brake torque may be used.

Of course, in some embodiments, when the work vehicle 1 is in operation, the swing system controller may determine that the swing brake 10 should be in one of the first, second or third configurations based on a user input. That is, a user may manually control the configuration of the swing brake 10.

INDUSTRIAL APPLICABILITY

According to this disclosure, a method of controlling a swing system 3 of a work machine 1 is provided. According to the method, a pilot pressure is used to actuate both a parking brake 20 and a drift brake 30 of the swing system 3. As such, this disclosure provides for the control of a parking brake 20 and a drift brake 30 of the swing system via a common pilot pressure.

Furthermore, according to the method the parking brake 20 is applied at a first pilot pressure, which is lower than the second and third pilot pressures where the parking brake 20 is disapplied. In effect, the parking brake 20 may be a negative brake (i.e. normally on brake) such that when the swing system 3 is non-operational (e.g. in a parked mode), the parking brake 20 may be applied to the swing system 3. Operation of the swing system 3 which results in the pilot pressure being increased may allow the drift brake 30 and the parking brake 20 to be disapplied to the swing system 3 (e.g. to allow rotation of the swing system, or to apply the drift brake). As such, the drift brake 30 may be a positive brake which is suitable for opposing rotation of the swing system 3 during operation of the work vehicle 1.

In some embodiments, the work vehicle 1 may be an excavator. As such, the method of this disclosure may be particularly advantageous for controlling the rotation of an upper body of an excavator relative to a lower body of the excavator.

In some embodiments, the swing system 3 of the work vehicle may be driven by a hydraulic motor 4*a* which is provided a part of a closed-loop hydraulic system. For such hydraulic systems, the method of this disclosure may be utilised to reduce or prevent unintentional slippage/rotation of the swing system 3 during use of the work vehicle 1 without resorting to applying the parking brake 20. Application of the parking brake 20 during use of the work vehicle 1 may result in excessive loading of the swing system 3 due to the relatively large parking brake torque associated with the parking brake 20 and/or may result in excessive wear of the parking brake 20.

What is claimed is:

1. A method of controlling a swing system of a work machine, the swing system comprising a parking brake and drift brake, the method comprising:

outputting a pilot pressure to the parking brake and the drift brake based on an operation mode of the swing system, wherein:

when the pilot pressure is a first pilot pressure, the pilot pressure causes the parking brake to be applied to the swing system and the drift brake to be disapplied to the swing system;

when the pilot pressure is a second pilot pressure, the pilot pressure causes the parking brake to be disapplied to the swing system and the drift brake to be disapplied to the swing system, the second pilot pressure being greater than the first pilot pressure; and when the pilot pressure is a third pilot pressure, the pilot pressure causes the parking brake to be disapplied to the swing system and the drift brake to be applied to the swing system, the third pilot pressure being greater than the second pilot pressure.

2. The method according to claim 1, wherein:

when the parking brake is applied to the swing system, the parking brake applies a predetermined parking brake torque to the swing system.

3. The method according to claim 2, wherein:

the parking brake comprises a first spring element, wherein the first spring element biases the parking brake to apply the parking brake torque to the swing system.

4. The method according to claim 2, wherein:

when the drift brake is applied to the swing system, the drift brake applies a drift brake torque to the swing system, the drift brake torque being lower than the parking brake torque.

5. The method according to claim 4, wherein:

when the pilot pressure is between the third pilot pressure and a fourth pilot pressure, the fourth pilot pressure being greater than the third pilot pressure, the drift brake torque applied to the swing brake system may be varied between a minimum drift brake torque and a maximum drift brake torque based on the pilot pressure.

6. The method according to claim 1, wherein:

the pilot pressure output to the drift brake and the parking brake is controlled by a proportional hydraulic valve.

7. The method according to claim 5, further comprising:

obtaining information indicative of a work machine operation mode; and controlling the pilot pressure output to the drift brake and the parking brake based on the work machine operation mode.

8. The method according to claim 7, wherein:

where information indicative of the work machine being in a parked operation mode is obtained, the method comprises outputting the first pilot pressure; and/or where information indicative of the work machine being in a swinging operation mode is obtained, the method comprises outputting the second pilot pressure.

9. The method according to claim 7, wherein:

where information indicative of the work machine being in a digging operation mode or a driving operation mode is obtained, the method comprises outputting a pilot pressure between the third and fourth pilot pressures.

10. The method according to claim 1, further comprising:

obtaining positional information indicative of a position of the swing system and/or a position of the work machine;

wherein the drift brake torque applied by the drift brake is controlled based on the positional information.

11. The method according to claim 10, wherein:

the positional information comprises one or more of a yaw, pitch, and roll of the swing system and/or one or more of a yaw, pitch, and roll of the work machine.

12. A swing system controller for a swing system of a work machine, the swing system controller configured to:

obtain an operation mode of the swing system;

control a pilot pressure output to a parking brake and a drift brake of the swing system based on the operation mode, wherein the swing system controller is configured to cause the swing system to operate in:

a first configuration in which a first pilot pressure causes the parking brake to be applied to the swing system and the drift brake to be disapplied to the swing system;

a second configuration in which a second pilot pressure causes the parking brake to be disapplied to the swing system and the drift brake to be disapplied to the swing system, the second pilot pressure being greater than the first pilot pressure; and a third configuration in which a third pilot pressure causes the parking brake to be disapplied to the swing system and the drift brake to be applied to the swing system, the third pilot pressure being greater than the second pilot pressure.

13. A swing system for a work machine, the swing system configured to cause an upper body of a work machine to rotate relative to a lower body of the work machine, the swing system comprising:

a parking brake configurable to apply a parking brake torque to oppose a rotation of the swing system based on a pilot pressure;

a drift brake configurable to apply a drift brake torque to oppose the rotation of the swing system based on the pilot pressure;

a swing system controller according to claim 12.

14. The swing system according to claim 13, further comprising:

a swing motor configured to cause the upper body of the work machine to rotate relative to the lower body of the work machine; and a hydraulic pump configured to pump hydraulic fluid to the swing motor to cause the swing motor to rotate.

15. The swing system according to claim 14, wherein:

the hydraulic pump is connected to the hydraulic motor as a closed loop hydraulic system.

* * * * *